United States Patent [19]

Gersch

[11] 4,191,098

[45] Mar. 4, 1980

[54] NOZZLE FOR AIR CONDITIONING UNITS

[75] Inventor: Dietfried Gersch, Giessen, Fed. Rep. of Germany

[73] Assignee: Kessler & Luch GmbH, Giessen, Fed. Rep. of Germany

[21] Appl. No.: 903,404

[22] Filed: May 8, 1978

[30] Foreign Application Priority Data

May 21, 1977 [DE] Fed. Rep. of Germany ..... 2723006

[51] Int. Cl.[2] ..... F24F 13/06; F24F 13/08

[52] U.S. Cl. ..... 98/40 N; 98/40 C; 98/41 R; 251/138

[58] Field of Search ..... 98/40 E, 40 C, 40 N, 98/40 D, 40 B, 41 R, 41 AV, 41 SV; 137/601, 637.2; 251/138

[56] References Cited

U.S. PATENT DOCUMENTS

| | | | |
|---|---|---|---|
| 2,477,619 | 8/1949 | Kennedy | 98/40 C |
| 2,621,579 | 12/1952 | Person et al. | 98/40 B |
| 3,004,348 | 10/1961 | Gustafsson | 98/40 N |
| 3,010,692 | 11/1961 | Jentoft | 98/40 B |
| 3,055,145 | 9/1962 | Lindsay | 98/40 N |
| 3,070,346 | 12/1962 | Kennedy | 98/41 R |
| 3,870,275 | 3/1975 | Kallel | 251/138 |

FOREIGN PATENT DOCUMENTS

| | | | |
|---|---|---|---|
| 715096 | 9/1954 | United Kingdom | 98/41 AV |

*Primary Examiner*—Henry C. Yuen
*Attorney, Agent, or Firm*—Gilbert L. Wells

[57] ABSTRACT

An air conditioning unit comprises as the air outlet member a nozzle which is subdivided into a primary nozzle and a secondary nozzle. The primary nozzle consists of a hollow cone on the inside of which is coaxially arranged a truncated cone. The cone is displaceable in axial direction. With its base the hollow cone is mounted on an air conducting tube supplying the primary air. The secondary nozzle consists of a sleeve coaxially surrounding the hollow cone and being of a larger diameter so as to leave a free space between the inner sleeve wall and the hollow cone. The sleeve is mounted with its one end spaced from the air conducting tube, thereby leaving an entrance between the sleeve and the hollow cone for the room air. By this particular design a comparatively large circulation of room air is attained with the least possible energy of primary air.

7 Claims, 5 Drawing Figures

NOZZLE FOR AIR CONDITIONING UNITS

BACKGROUND OF THE INVENTION

The present invention relates to air conditioning units. More particularly the invention is concerned with the design of the nozzles connected to the air conducting tube as the air outlet member.

The air conducting tube may end in a single nozzle or there may be connected a plurality of nozzles to one tube. Through the nozzles the primary air from the tube is blown into the room which results not only in a supply of fresh (primary) air but also in a circulation of the air already present in the room (room air or secondary air).

It is the object of the present invention to provide a nozzle that effects the circulation of a large volume of room air but still requiring the least possible amount of primary air energy.

It is a further object of the invention to achieve the circulation of the room air at the least possible noise level.

It is another object of the invention to make the length of the air jet in the room variable from a maximum length down to about 10% of said length.

It is still another object of the invention to provide means for balancing the air jets against one another if more than one nozzle is connected to the air conducting tube.

SUMMARY OF THE INVENTION

The above stated objects are attained by a nozzle which consists of a primary nozzle and a secondary nozzle. The primary nozzle comprises a hollow cone preferably made of sheet metal or of plastic. On the inside of the hollow cone there is coaxially arranged a solid truncated cone which is displaceable in axial direction.

With its large diameter end, i.e. its base, the hollow cone is fixedly mounted on the air conducting tube.

Further there is provided a secondary nozzle which consists of a sleeve having a considerably larger diameter than the hollow cone and surrounding the latter coaxially. Therefore a free space exists between the inner wall of the sleeve and the outer wall of the hollow cone. The sleeve is mounted spaced from the air conducting tube so that there exists an open ring between one sleeve end and the air conducting tube. This opening provides an entrance for the room air. When primary air flows from the air conducting tube through the primary nozzle and the sleeve (=secondary nozzle) a depression is generated at the entrance which causes the room air to flow into the entrance and become carried along with the primary air.

By axially displacing the solid truncated cone inside the hollow cone the flow of the primary air may be regulated and consequently the ratio between the primary air and the room air (secondary air) may be varied.

Further, in the outlet end of the sleeve there are provided blades which extend in radial direction within the sleeve. The blades are pivotable and may be used for regulating the direction of the outflowing air.

BRIEF DESCRIPTION OF THE DRAWINGS

The invention will be more readily comprehended from the following description when taken in conjunction with the appending drawings, wherein.

DESCRIPTION OF THE PREFERRED EMBODIMENT

Figure 1:
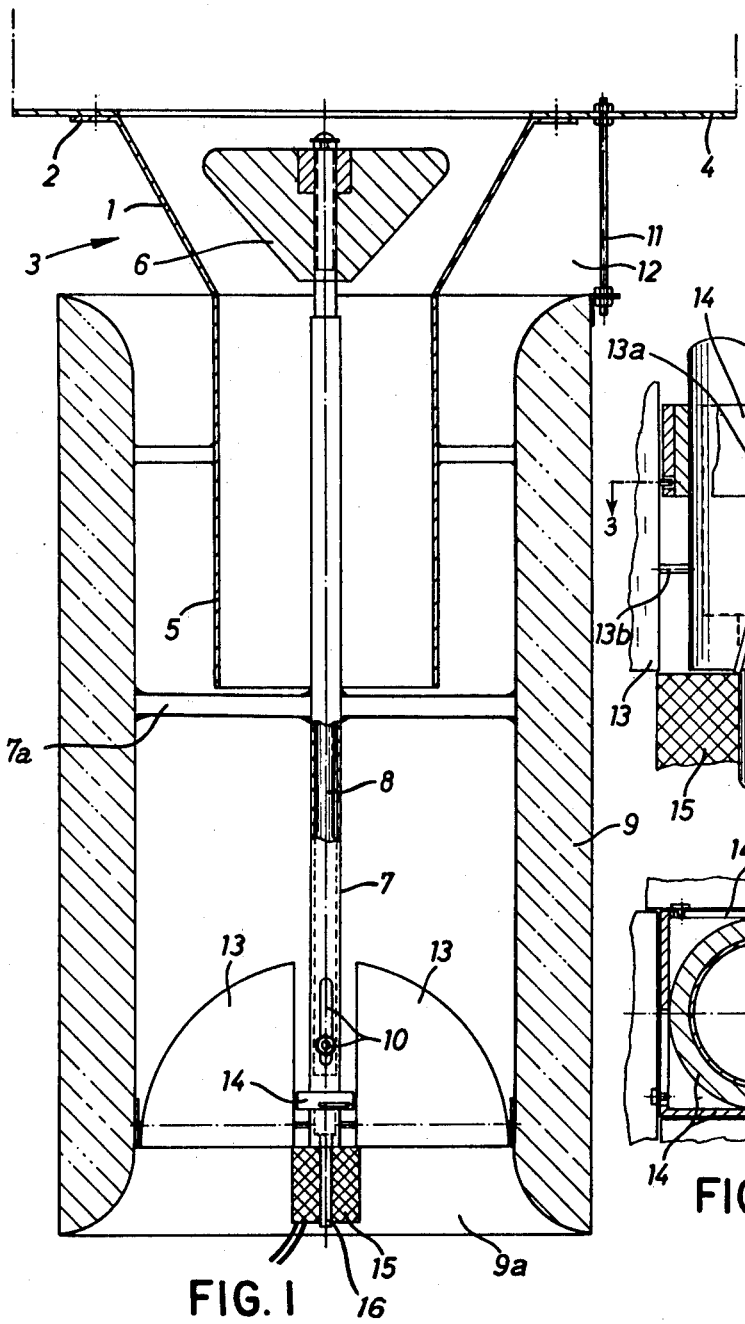
FIG. 1 shows schematically a cross-sectional view of the primary and the secondary nozzles according to the invention.

In FIG. 1 a hollow cone 1 is provided with a collar 2 by means of which the cone 1 is fixedly connected to an air conducting tube 4 which is only schematically shown. On the opposite side the hollow cone ends in a cylinder 5. The cone 1 and the cylinder 5 together represent the primary nozzle 3.

Within the hollow cone 1 there is arranged a truncated cone 6 at the end of a rod 8 which is displaceable in axial direction in a pipe 7. The pipe has a slot in which a fastening screw slides. The screw is firmly connected with the rod 8. A nut may be tightened on the screw so that a specific relative position of the rod 8 inside the pipe 7 may be secured.

A sleeve 9 is carried by four bolts 11 so that the sleeve surrounds the cone 1 and the cylinder 5 concentrically, and one end of the sleeve is spaced from the air conducting tube 4. This sleeve 9 represents the secondary nozzle.

The pipe 7 is fastened to the inner wall of the sleeve 9 by connection rods 7*a*.

The rod 8 and the pipe 7 extend to the blow-out end of the sleeve 9. In this area four blades 13 are arranged to extend in radial direction between the pipe 7 and the inner wall of the sleeve 9. The blades are hinged pivotably to the pipe 7 and the sleeve 9 by pins 13*b*.

Each blade comprises further a pin 13*a* spaced from the pin 13*b*. The pin 13*a* in each blade serves to pivot the blade. This function will be better understood from the FIGS. 2 and 3. The pin 13*a* slides in a slot 14*a* in a frame 14 which is in fixed connection with an annular slide ring designated by the same reference numeral 14. The slide ring 14 is connected to a cylindrical member 16 inside the pipe 7. The member is movable in the direction of the double-headed arrow A by means of an electromagnet 15. Upon movement of the frame/slide 14 the pin 13*a* will be displaced in the slot 14*a* between two extreme positions which are given by the ends of the slot 14. This causes the blades 13 to become pivoted about the pins 13*b*.

Figure 2:
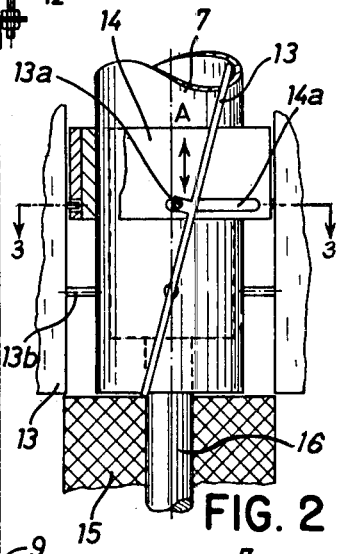
FIG. 2 is a schematic partial view on an enlarged scale of the drive mechanism of the pivotable blades.
Figure 3:
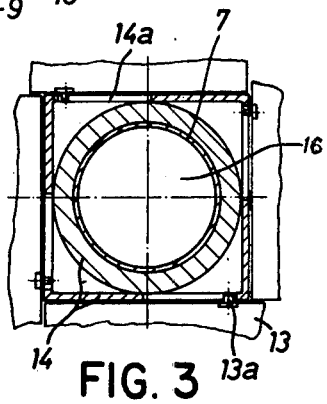
FIG. 3 shows a cross-section cut along line III—III of FIG. 2.

It should be noted, however, that in FIG. 2 the pin 13*a* is shown in its left-hand end position while in FIG. 3 the same pin 13*a* is shown in its right-hand end position. This has been done to illustrate the sliding movement of the pin 13*a* in the slot 14.

The rod 8 is manually displaced in axial direction inside the pipe 7. Its selected position is then securedby tightening the nut. By displacing the rod 8 the truncated cone 6 will be moved in its position so that the entrance for the primary air from the air conducting tube is more or less opened or closed. The base edge of the truncated cone is rounded-off so that noise producing air turbulences are avoided. The angles of the generating lines of both the hollow cone 1 and the truncated cone 6 on the one hand and the axis on the other hand are such that the surface area of the annular ring defined between the hollow cone and the truncated cone is the same in every throttle position of the truncated cone 6.

The blades 13 are pivoted by the electromagnet 15. To this end more or less power is supplied to the coil of the electromagnet so that the member 16 is more or less drawn into the coil. This movement may be accomplished against the force of a spring which is not shown for sake of simplicity.

Figure 4A:
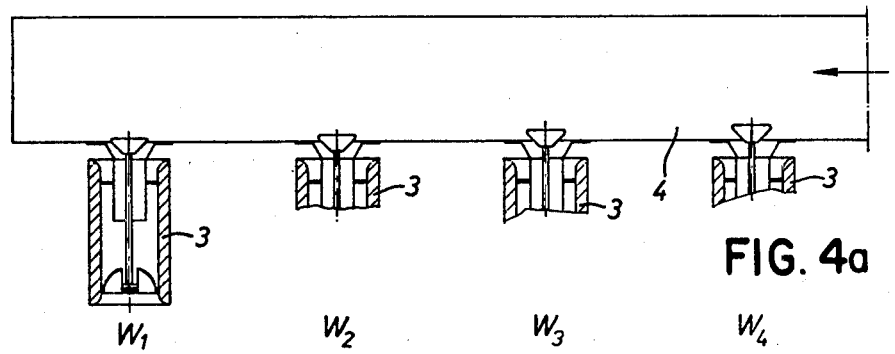
FIG. 4*a* shows four air nozzles attached to one common air conducting tube.
Figure 4B:
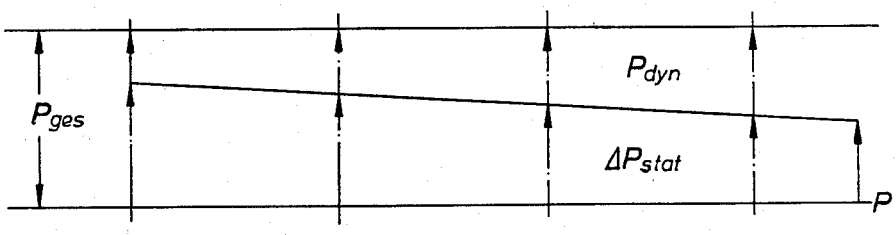
FIG. 4*b* shows in diagrammatic form the pressure relation between primary air and secondary air prevailing during four different positions of the solid cone of the primary nozzles.

In FIG. 4*a* there is shown an air conducting tube 4 on which four nozzles 3 are mounted. The nozzles are illustrated in more or less open state to show how the primary air nozzles are balanced relative to one another in the direction of the air flow. In this manner it is achieved that the total pressure, i.e. the dynamic pressure plus the static pressure ($P_{total}=P_{dyn.}+P_{st.}$) remains constant throughout the channel length (FIG. 4*b*). As a consequence thereof there emerges from each nozzle the same volume W of air mixture consisting of primary and secondary air.

What is claimed is:

1. A common air conducting tube of air conditioning units having a plurality of air nozzles mounted therein, each of said air nozzles comprising:

(a) a primary nozzle in the form of a hollow cone fixedly mounted with its base on the air conditioning tube;

(b) a secondary nozzle in the form of a sleeve, said sleeve having a larger diameter than the small end of the hollow cone and being arranged concentrically to the hollow cone, one end of the sleeve facing the air conducting tube but being spaced therefrom so as to define an annular opening between the outside of the hollow cone and the inner wall of the sleeve, the other end of the sleeve forming a blow-out end;

(c) a truncated cone arranged coaxially on the inside of the hollow cone so as to define an annular opening between the outside of said truncated cone and the inner wall of said hollow cone;

(d) means for displacing said truncated cone in axial direction comprising a pipe mounted stationarily and concentrically in said sleeve and an axially displaceable rod guided in said pipe, the truncated cone being mounted on the front end of said rod;

(e) blades at the blow-out end of the sleeve extending in radial direction between the inner wall of the sleeve and the outer wall of the pipe; said blades being supported on pins in the walls of the sleeve and the pipe so as to be pivotable in different directions; and (f) means for angularly pivoting all blades simultaneously, whereby adjustments are made in said air nozzles in the direction of flow of primary air so that the total pressure along the length of the air conducting tube equals the sum of dynamic pressure and static pressure and the total pressure is constant.

2. An air nozzle as outlet element of an air conducting tube of air conditioning units, said nozzle comprising:

(a) a primary nozzle in the form of a hollow cone fixedly mounted with its base on the air conducting tube;

(b) a secondary nozzle in the form of a sleeve, said sleeve having a larger diameter than the small end of the hollow cone and being arranged concentrically to the hollow cone, one end of the sleeve facing the air conducting tube but being spaced therefrom so as to define an annular opening between the outside of the hollow cone and the inner wall of the sleeve, the other end of the sleeve forming a blow-out end;

(c) a truncated cone arranged coaxially on the inside of the hollow cone so as to define an annular opening between the outside of said truncated cone and the inner wall of said hollow cone;

(d) means for displacing said truncated cone in axial direction comprising a pipe mounted stationarily and concentrically in said sleeve and an axially displaceable rod guided in said pipe, the truncated cone being mounted on the front end of said rod;

(e) blades at the blow-out end of the sleeve extending in radial direction between the inner wall of the sleeve and the outer wall of the pipe; said blades being supported on pins in the walls of the sleeve and the pipe so as to be pivotable in different directions; and (f) means for angularly pivoting all blades simultaneously.

3. An air nozzle as claimed in claim 1, wherein the angle between the generating line of the hollow cone and the cone axis and the angle between the generating line of the truncated cone and the cone axis are so designed that the annular ring defined between the hollow cone and the truncated cone covers substantially equal areas in all positions of the truncated cone.

4. An air nozzle as claimed in claim 1, wherein the base edge of the truncated cone is rounded-off.

5. An air nozzle as claimed in claim 1, wherein the rod carrying the truncated cone extends to the blow-out end of the sleeve.

6. An air nozzle as claimed in claim 1, wherein said pivoting means comprises a sliding ring on said pipe, said ring having slots for engaging pins which are in fixed connection with said blades.

7. An air nozzle as claimed in claim 6, and further comprising an electromagnet for imparting a sliding motion to said sliding ring on said pipe.

* * * * *